US006202633B1

(12) United States Patent
Campagna et al.

(10) Patent No.: US 6,202,633 B1
(45) Date of Patent: Mar. 20, 2001

(54) MOLECULAR REACTOR FOR FUEL INDUCTION

(76) Inventors: Marc Jean Campagna, 1470 chemin d'Ayer's Cliff P.O. Box 175, Katevale Quebec (CA), J0B 1W0; Richard Herbert Colt, 1785 chemin de Ayer's Cliff, Ayer's Cliff Quebec (CA), J0B 1C0

( * ) Notice: Subject to any disclaimer, the term of this patent is extended or adjusted under 35 U.S.C. 154(b) by 0 days.

(21) Appl. No.: 09/435,695

(22) Filed: Nov. 8, 1999

Related U.S. Application Data

(63) Continuation of application No. PCT/CA98/00454, filed on May 8, 1998.
(60) Provisional application No. 60/046,049, filed on May 9, 1997.

(51) Int. Cl.[7] ..... F02B 51/04
(52) U.S. Cl. ..... 123/536; 123/543
(58) Field of Search ..... 123/543, 536, 123/549, 550, 551, 547, 537, 539, 538

(56) References Cited

U.S. PATENT DOCUMENTS

| | | | | |
|---|---|---|---|---|
| 3,279,770 | | 10/1966 | Parker . | |
| 3,749,545 | | 7/1973 | Velkoff . | |
| 3,805,492 | * | 4/1974 | King | 95/66 |
| 3,841,824 | * | 10/1974 | Bethel | 431/8 |
| 4,041,922 | * | 8/1977 | Abe et al. | 123/260 |
| 4,052,139 | * | 10/1977 | Paillaud et al. | 431/2 |
| 4,176,637 | * | 12/1979 | Cole | 123/537 |
| 4,183,339 | * | 1/1980 | Nagaishi et al. | 123/701 |
| 4,347,825 | | 9/1982 | Suzuki . | |
| 4,439,980 | * | 4/1984 | Biblarz et al. | 60/39.06 |
| 4,582,475 | * | 4/1986 | Hoppie | 431/6 |
| 4,845,480 | * | 7/1989 | Satou | 345/1 |
| 4,850,188 | | 7/1989 | Testone . | |
| 4,892,139 | * | 1/1990 | LaHaye et al. | 165/95 |
| 5,123,362 | * | 6/1992 | Kikuchi | 110/341 |
| 5,503,133 | * | 4/1996 | Trigger | 123/637 |
| 5,695,328 | * | 12/1997 | DeFreitas et al. | 431/268 |
| 5,763,930 | * | 6/1998 | Partio | 250/504 R |

FOREIGN PATENT DOCUMENTS

| | | |
|---|---|---|
| 2 594 491 | 8/1987 | (FR) . |
| 1 179 326 | 1/1970 | (GB) . |
| WO 92 04973 | 4/1992 | (WO) . |

* cited by examiner

*Primary Examiner*—Willis R. Wolfe
*Assistant Examiner*—Hai Huynh
(74) *Attorney, Agent, or Firm*—Swabey Ogilvy Renault

(57) ABSTRACT

An apparatus for producing a highly combustible fuel comprising a reactor chamber maintained under negative pressure, a nozzle for spraying an atomized fuel under pressure into the reactor chamber forming atomized droplets, a nozzle for introducing air into the reactor chamber to mix in a reactor zone with the atomized fuel for supplying a high voltage electrical potential differential, including at least one electrode located in the reaction zone, for providing an electrical charge to the atomized droplets, and means for passing the resulting atomized fuel and air to the manifold of an internal combustion engine.

11 Claims, 11 Drawing Sheets

MOLECULAR REACTOR FOR FUEL INDUCTION

CROSS-REFERENCE TO RELATED APPLICATION

This application is a continuation application of PCT/CA98/00454, filed May 8, 1998, in which the United States of America was designated and elected, and which remains pending in the International phase until Nov. 9, 1999, which in turn claims priority from U.S. application Ser. No. 60/046,049, filed May 9, 1997, and the benefit of 35 U.S.C. 119(e).

BACKGROUND OF THE INVENTION

1. Field of the Invention

The present invention relates to a molecular reactor for fuel induction, and more specifically, to a method and apparatus for processing fuel and air for injection into an internal combustion engine.

2. Description of the Prior Art

Reference is made to copending PCT application PCT/CA98/00367 filed Apr. 16, 1998 for a FUEL AND PROCESS FOR FUEL PRODUCTION by the applicants. In that application the process and fuel is described. Thus, a process of producing a combustible fuel is described, comprising exposing a gaseous hydrocarbon fuel to an electrical field or plasma to produce a fuel of improved combustibility as compared with the hydrocarbon fuel.

The prior art, including U.S. Pat. No. 3,266,783, Knight, issued Aug. 16, 1966, and U.S. Pat. No. 4,347,825, Suzuki et al, issued Sep. 7, 1982, proposes charging the mixture of air and fuel with an electrical charge. In the case of Knight, the electrostatically charged droplets are said to disintegrate into submicron size. The charged particles will tend to repel each other and disperse themselves evenly in the volume of gas. An electromagnetic field is also required in order to control the direction and movement of the mixture of air and fuel in the carburetor. Suzuki et al proposes the charging of droplets to prevent the collection of fuel on the walls of the conduit downstream of the fuel nozzle.

Both of these examples require the use of an electrical current which can be detrimental to the process as it will more than likely create arcing, which is what is especially aimed to be avoided.

SUMMARY OF THE INVENTION

This invention seeks to provide a highly combustible fuel for motor driven vehicles, more efficient and exhibiting lower levels of exhaust pollutants than conventional mixtures of gasoline and air.

It is a further aim of the present invention to provide a reactor for reprocessing fuel and a gaseous, oxygeneous fluid in order to have more complete burning of the fuel in an internal combustion engine and to reduce the emissions thereof.

An apparatus in accordance with the present invention comprises a reactor chamber maintained under negative pressure, means for spraying fuel under negative pressure into the reactor chamber, means for introducing air under negative pressure into the reactor chamber to mix in a reactor zone with the fuel, a pair of electrodes in the reactor chamber, in the reaction zone, and means for producing a high voltage, low current charge between the electrodes for charging the fuel droplets.

In a more specific embodiment, means are provided for passing the resulting gases to a second reactor chamber whereby the second chamber defines a second reaction zone, means for introducing steam into the reaction zone with the gases from the first chamber, means for applying heat and negative pressure to the second reactor chamber, a pair of electrodes, and means for introducing the resultant fuel from the second reactor chamber into the manifold of an internal combustion engine.

In a still more specific embodiment the apparatus includes means for applying heat into the first reaction zone.

A method in accordance with the more specific embodiment of the present invention comprises the steps of spraying liquid fuel into a chamber under negative pressure, introducing air into the chamber, applying a negative electron discharge into the chamber for producing an intermediate fuel, introducing the intermediate fuel into a second reaction chamber, introducing steam into the second reaction chamber with the intermediate fuel, removing unwanted electrons from the second chamber for producing a final fuel, and introducing the final fuel into the manifold of an internal combustion engine.

In the process of the invention, a gaseous hydrocarbon fuel is exposed to an electrical field or plasma, more especially an electrical ionization potential difference, or to ultraviolet radiation, microwave radiation or laser.

The exposure may be carried out in the presence of a gaseous carrier fluid, for example, an oxygeneous fluid such as oxygen and/or air, or a mixture of oxygen and/or air and steam or gaseous water vapor. Other gaseous carrier fluids include nitrogen and the inert gases, for example, argon and helium.

While not wishing to be bound by any particular theory as to the mechanism of combustible fuel production, it is postulated in one theory that the electrical ionization potential difference or the radiation activates the gaseous hydrocarbon fuel to a high energy state; more especially the hydrocarbon molecules or ions of the fuel are thought to be electronically excited to a state in which they are more reactive or more susceptible to combustion than the hydrocarbon fuel in the non-excited state.

Another theory is that the process generates an extremely finely divided aerosol having a particle size far smaller than that achieved with a normal carburetor or fuel injector equipped system. Under the conditions of formation, the droplet particles are initially formed in a strongly, electrically charged condition. This is a metastable condition, leading immediately to the disruption of the highly charged droplets by internal coulombic repulsion and the formation of much more finely divided droplets, each of which carries a portion of the charge initially held by the original droplet. These second generation droplets may then rapidly and similarly undergo further disruption and dispersion and so on until the fuel-air mixture enters the combustion chambers and is ignited. Mutual electrostatic repulsion between these fuel particles prevents them from coalescing back to larger droplets. Furthermore, the droplets enter the combustion chambers relatively more finely divided than in a normal carburetor or fuel injector equipped system. Since burning of the fuel in the combustion chambers occurs at the fuel particle surface, its rate is therefore dependent upon the surface area. Burning at high engine speeds is incomplete before normally sized droplets in the normal carburetor or fuel injector equipped systems are ejected as exhaust, and therefore completeness of combustion is compromised if the droplet size is large. On the other hand, an extremely finely divided dispersion provides a huge increase in the surface area for burning and leads to much more complete combustion with the resulting decrease in carbon monoxide and unburnt hydrocarbon emissions which are observed with this invention.

The presence of the charge on the droplets of the aerosol likely enhances the ease with which the fuel dispersion is combusted, especially when the droplets are negatively charged, since the negatively charged droplets would have an increased affinity for oxygen adduction.

It is also possible, but not confirmed, that this excited state or charged droplets of the hydrocarbon molecules or ions may become bound to the gaseous carrier fluid, especially when the carrier fluid is an oxygeneous fluid, such as by forming an adduct between the oxygeneous fluid and the charged droplets.

In a particular process within the aforementioned general process, a gaseous, oxygeneous fluid is introduced into an atmosphere of gaseous hydrocarbon fuel maintained under vacuum.

The gaseous, oxygeneous fluid is suitably oxygen and/or air, or a mixture of oxygen and/or air and steam or gaseous water vapor.

The hydrocarbon fuel is suitably gasoline by which is to be understood the various grades of gasoline motor fuel; hydrocarbon fuel may also be diesel oil, natural gas or propane.

Conveniently the atmosphere of gaseous hydrocarbon fuel is formed by vaporizing a liquid hydrocarbon fuel, for example, gasoline, under vacuum or a slight pressure in a chamber. The use of a vacuum facilitates formation of the gaseous atmosphere from the liquid hydrocarbon fuel. Conveniently the vacuum corresponds to a negative pressure of 3 to 28 (7.62 cm to 71.12 cm), preferably 10 to 28 inches (25.4 cm to 71.12 cm) of mercury. When the vaporization is carried out at a slight pressure, this is suitably 15 to 16 psi (1.0206 atm to 1.08864 atm) and the atmosphere is formed at a temperature, relative to the pressure, of up to but not to exceed the fuel flash point. Test temperature can be increased up to the flash point of hydrocarbon fuel, but not exceeding it or explosion of said fuel can occur, resulting in personal injury to the experimenter.

Suitably the vaporization is carried out at an elevated temperature, which conveniently is 250° F. to 450° F. (121° C. to 232° C.), more especially 350° F. to 410° F. (177° C. to 210° C.). The pressure extending from vacuum through partial vacuum to a slight positive pressure may be considered to be 0–16 psi (1.08864 atm).

The gaseous, oxygeneous fluid is conveniently introduced continuously into the hot atmosphere in the chamber, and the formed combustible fuel is continuously withdrawn from the chamber and delivered to the cylinders of an internal combustion engine, preferably within 5 minutes of its formation, and more preferably within milliseconds of formation.

The electrical ionization potential established across the atmosphere of the hydrocarbon fuel containing the oxygeneous fluid is suitably 200–8000 volts, more usually 600–5000 volts. This is achieved by a pair of spaced-apart electrodes disposed so as to be within the aforementioned atmosphere. The spacing of the electrodes is such that any current flow resulting from the potential difference applied across the electrodes is minimal, typically of the order of 0.2 to 0.8 microamps. An average of 0.5 microamps was measured in the test set-up described herein. It should be noted that electrode area and configuration will affect the current flow. Arcing must not occur between electrodes or against any part of the set-up.

In reactors employed for carrying out the invention, one electrode is disposed within the reactor and the other electrode may be defined by the wall of the reactor.

In one particular embodiment, the hydrocarbon fuel is sprayed into a chamber from a spray nozzle and the oxygeneous fluid is introduced separately into the chamber, and a potential difference is established between the spray nozzle and a wall of the chamber particularly so as to produce negatively charged fuel droplets. In this embodiment, the spray nozzle functions as an electrode.

In the preferred embodiment in which air is employed as the gaseous, oxygeneous fluid, the air and the gaseous hydrocarbon fuel are suitably employed in a volume ratio of air to gaseous hydrocarbon fuel of 10 to 30:1, preferably 12 to 17:1.

The combustible fuel may be fed directly to the cylinders of an internal combustion engine. No carburetor, choke or injection system is employed. A condensate of the combustible fuel may also be formed, by subjecting the fuel to condensing conditions such as by cooling.

The combustible fuel in gaseous form does not require long term stability as it is normally formed as required and is burned continuously as it is produced, usually within a few milliseconds. The gaseous combustible fuel reverts to a liquid after about 10 minutes.

BRIEF DESCRIPTION OF THE DRAWINGS

Having thus generally described the nature of the invention, reference will now be made to the accompanying drawings, showing by way of illustration a preferred embodiment thereof, and in which.

DESCRIPTION OF THE PREFERRED EMBODIMENTS

Figure 1:
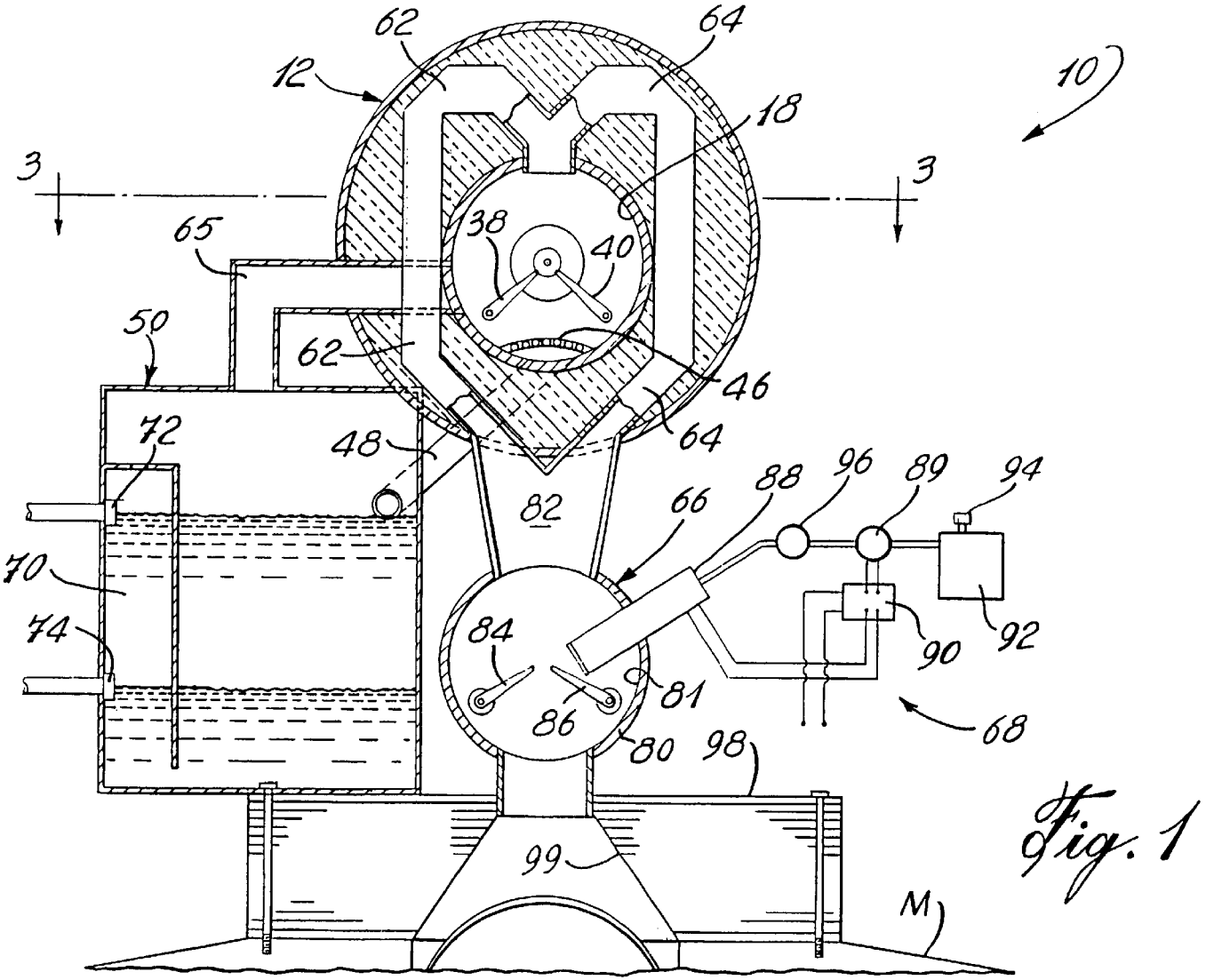
FIG. 1 is a vertical cross-section taken along a transverse plane of an embodiment of the apparatus.
Figure 2:
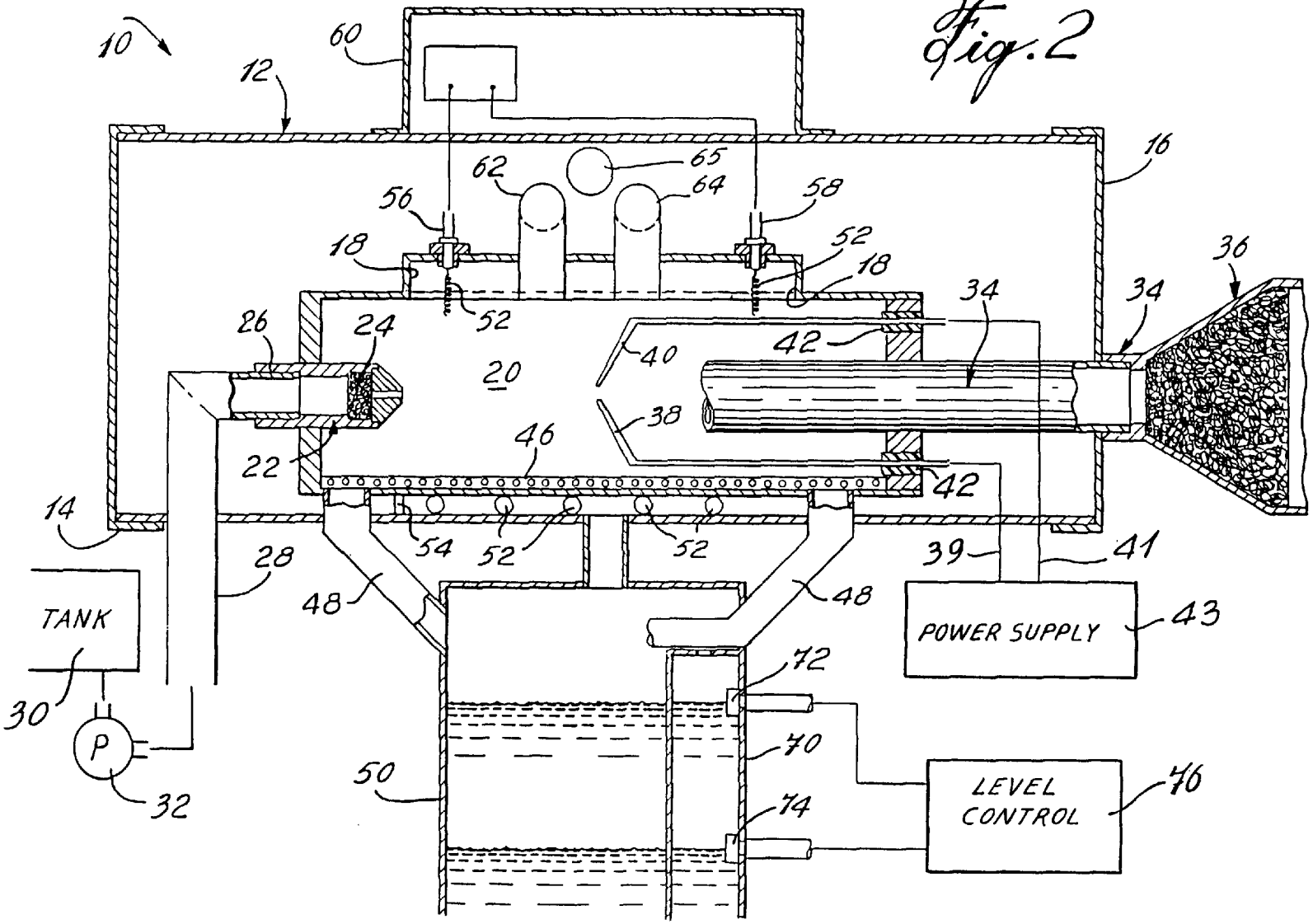
FIG. 2 is a vertical cross-section thereof.
Figure 3:
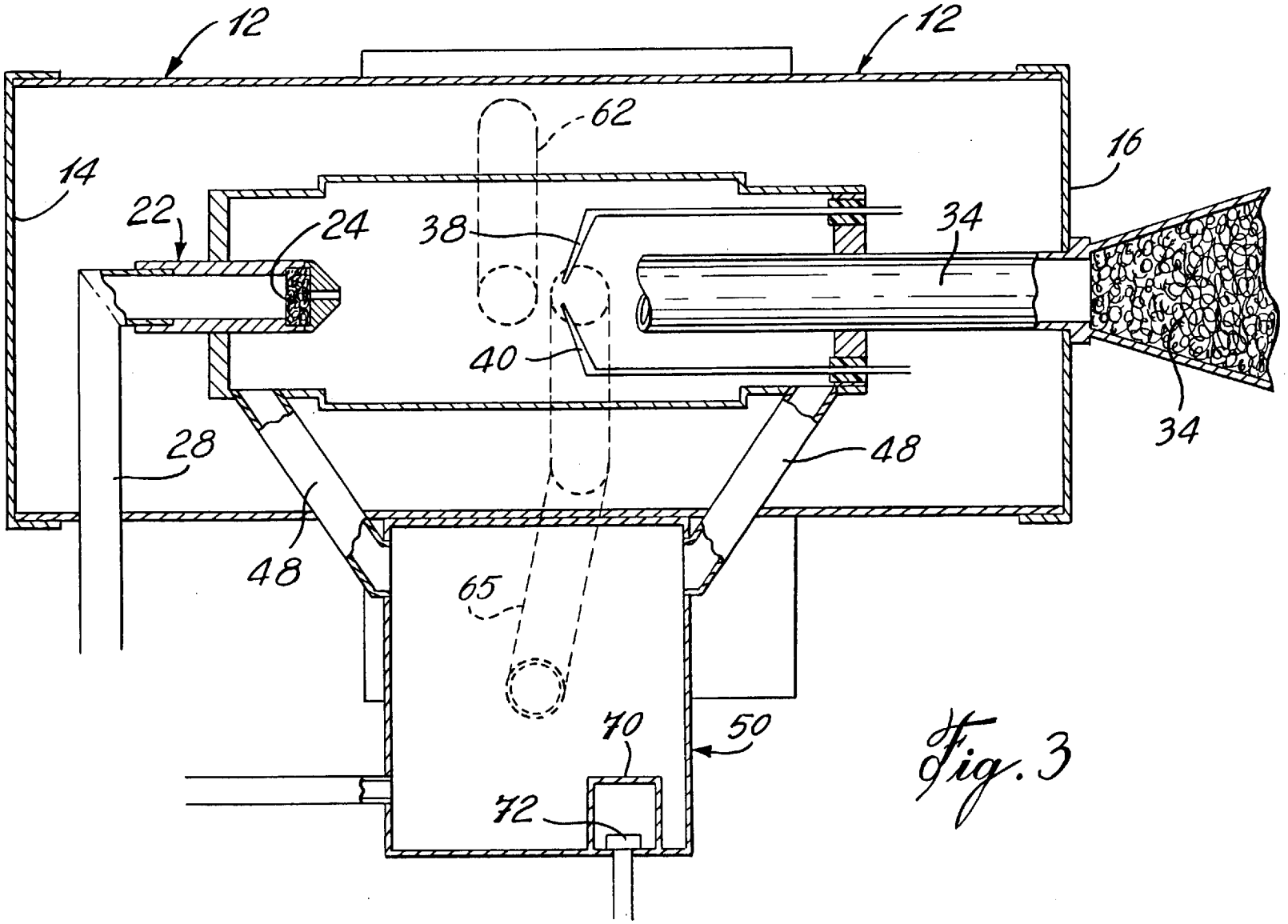
FIG. 3 is a horizontal cross-section taken along line 3—3 of FIG. 1.

Referring now to the drawings, and particularly FIGS. 1 to 3, there is shown a reactor 10 having a housing 12 having end caps 14, 16 and a cylindrical core reactor chamber 18. Within this cylindrical chamber 18 is a reaction zone 20. From one end of the housing 12 and directed longitudinally into the core chamber 18 is a fuel nozzle 22 having a micron filter 24 and connected to a nozzle coupler 26 with a fuel line 28 coming from a tank 30 and a high pressure pump 32.

Extending from an opposite longitudinal direction to the housing 12 is an air inlet 34. The air is filtered through the air filter 36 and is injected into the reactor zone 20 directly opposite a fuel nozzle 22. A pair of copper electrodes 38 and 40 are insulated with Viton insulation 42 from the housing 12 of the reactor 10. The electrodes 38 and 40 are identically charged and, in this example, are both negative.

The Viton insulation 42 and electrodes 38 and 40 are connected through the leads to power supply 43, which is shown in FIG. 4. Alternatively, power can be provided by a variable power supply which can provide between −1,000 to −10,000 volts D.C. to the electrodes.

A condenser and heat exchanger 46 is provided in the bottom of the chamber 18 while drains 48 direct liquid fuel condensed in the bottom of the reactor to a recirculation fuel tank 50. The housing 12 includes a chrome hardened, nitronic treated shell enclosing an insulation made of ceramic wool. A heating element 52 may be provided in the chamber, or it may be a jacket surrounding the chamber housing 12 and attached by means of fasteners 54. The temperature in chamber 18 is maintained at 250° F. (121.2° C.) in the present example. Positive lead 56 and negative lead 58 are connected through a thermostat 60 to the heating element 52.

As seen in FIGS. 1 and 2, conduits 62, 64 communicate the primary reaction chamber 18 to the secondary reaction chamber 66, as will be described.

The chamber zone 20 is kept under negative pressure by means of a vacuum created by the internal combustion engine (not shown) through a vacuum outlet 65.

Figure 4A:
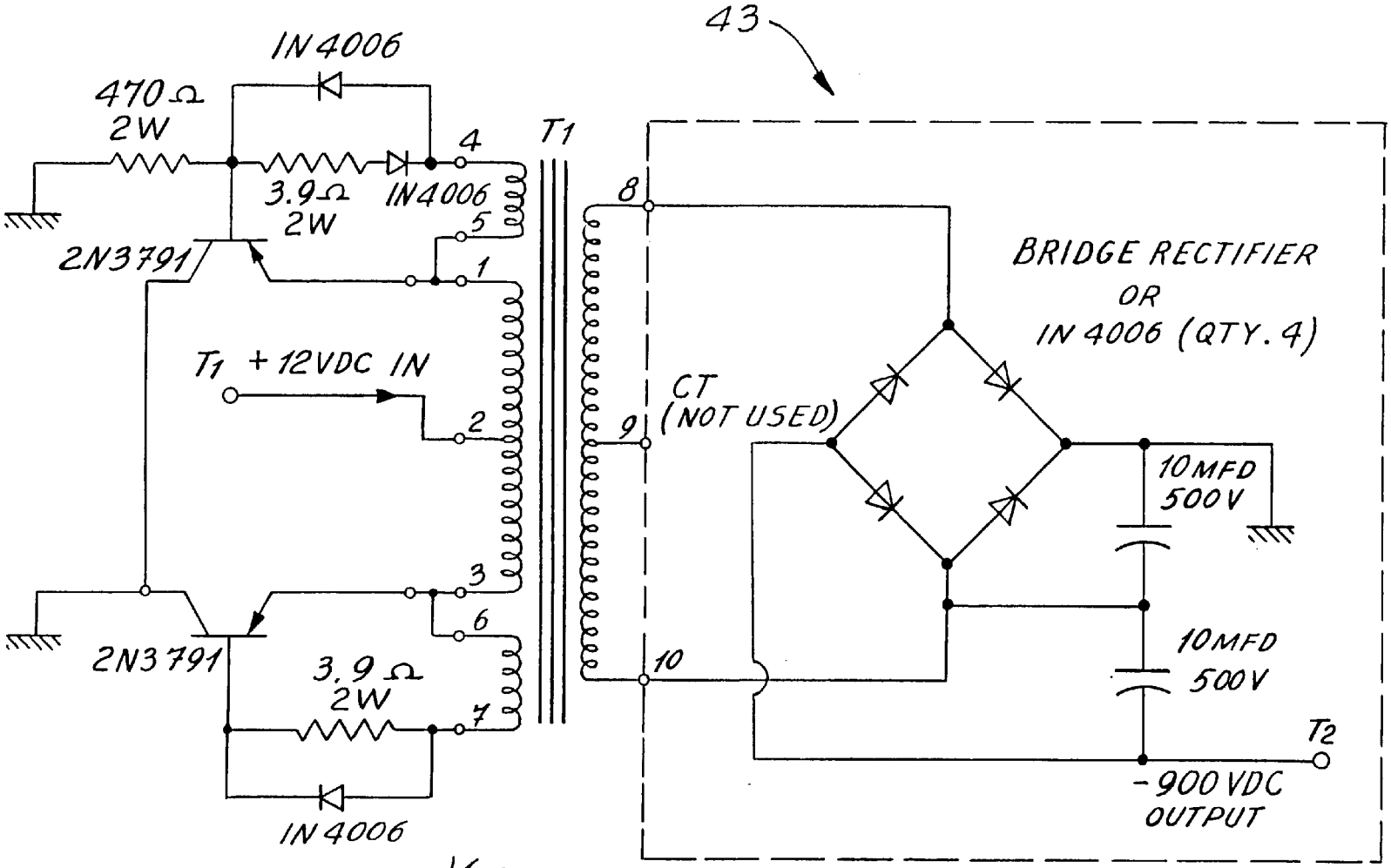
FIG. 4*a* is a diagram showing a detail of the present invention.
Figure 4B:
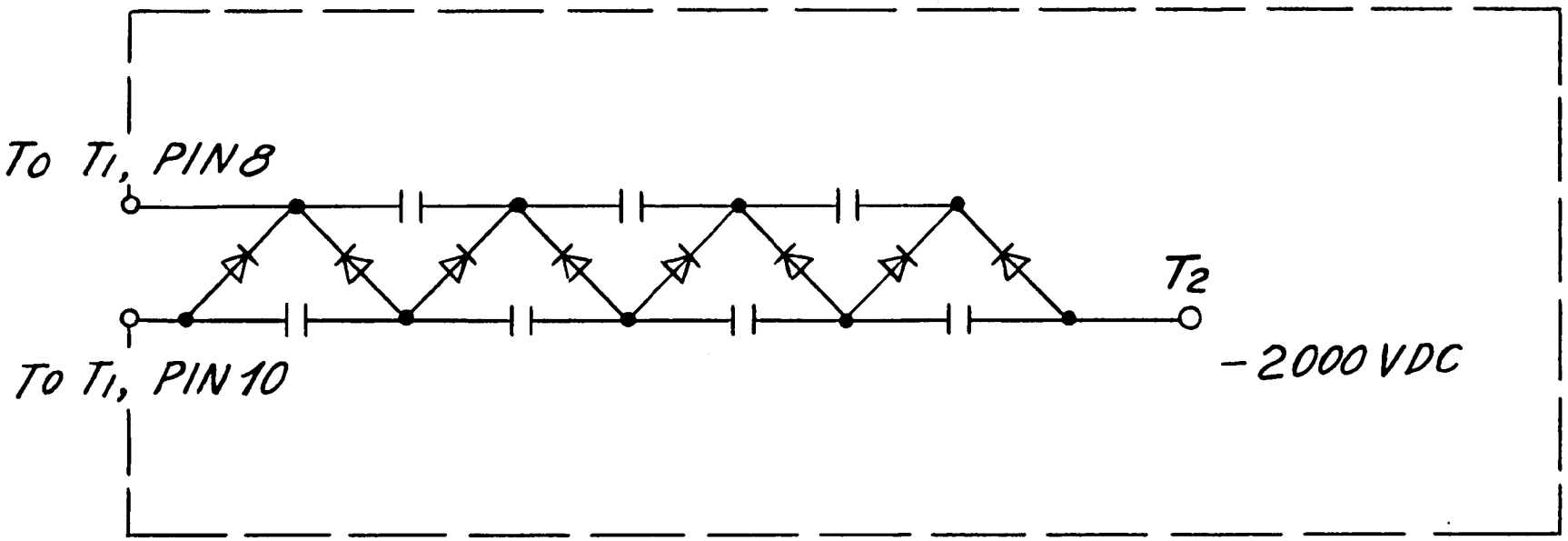
FIG. 4*b* is a diagram showing a further embodiment of a detail shown in FIG. 4*a;*

A power supply 43 is illustrated in FIG. 4*a* and is connected to the leads 39 and 41 in FIG. 2. The power supply, as shown in FIG. 4*a*, can generate up to −900 volts D.C. In one example, the voltage quadrupler shown in FIG. 4*b* has been substituted into the circuit of FIG. 4*a*. The quadruplet increased the output voltage to −1,980 volts D.C.

In operation, when the ignition switch 68 is turned on, fuel from tank 30 is passed by means of pump 32 to the spray nozzle 22 directed into the reactor zone 20. At the same time, air is passed through the air inlet 34 to confront the sprayed or atomized fuel in the reactor zone 20. The negative electrons are removed from the reactor zone 20 by means of the electrodes 38 and 40 to create a new fuel mixture. The fuel to air ratio may be between 14:1 and 30:1, but more preferably 14.7:1.

The mixture is discharged through conduits 62, 64 to the secondary chamber 66.

Not all of the fuel will have reacted in this chamber, and that fuel will be condensed by the condenser 46 to a liquid and passed through drains 48 into a recirculating tank 50.

Tank 50 is provided with a level control device which includes a liquid stabilizer sector 70 so that the fuel level in the tank can be more accurately determined by means of infrared level indicators 72 and 74. The infrared detector 72 determines the high level in the tank 50 while the detector 74 determines the low level.

Figure 5:
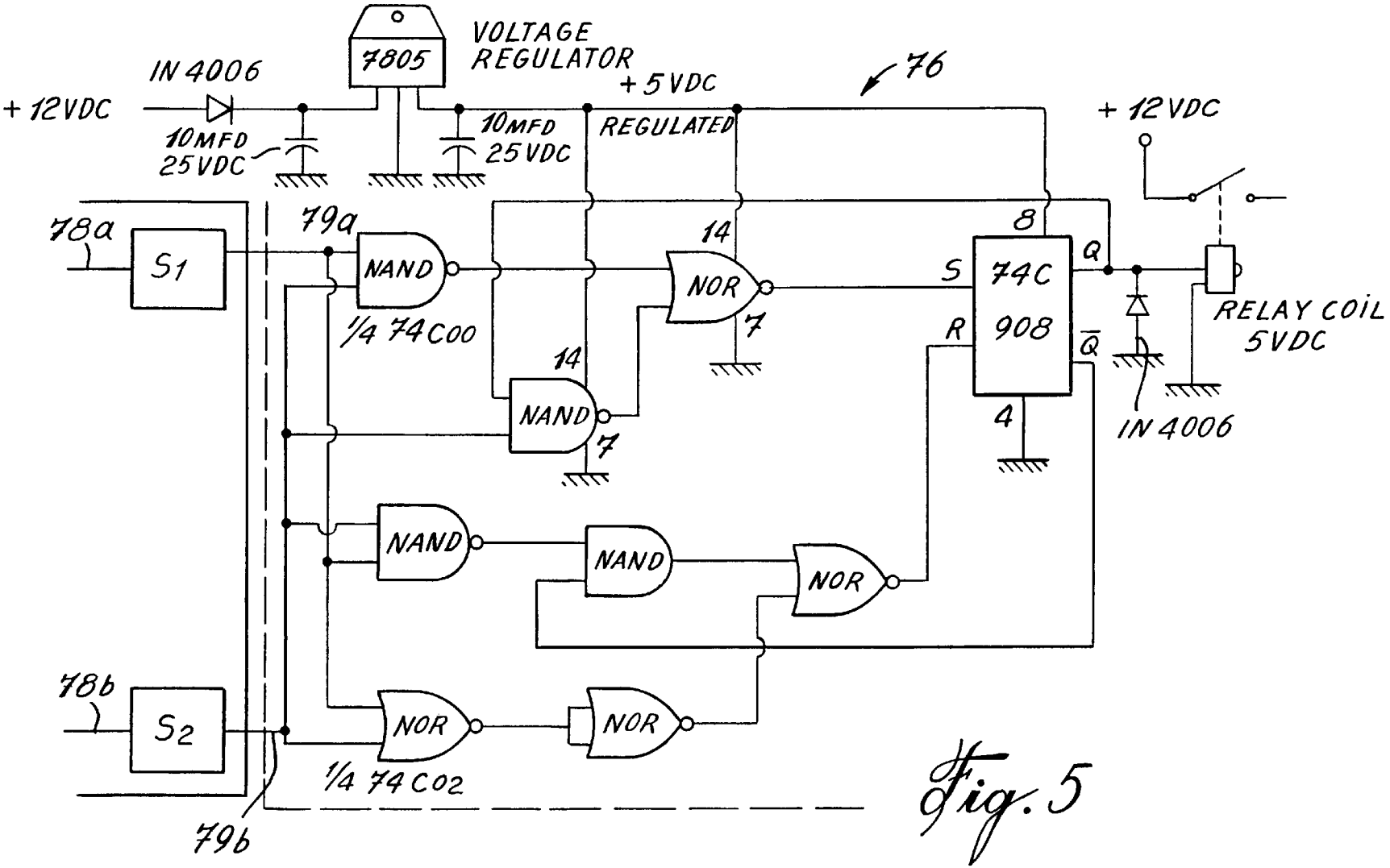
FIG. 5 is a diagram showing a further detail of the present invention.

The high level detector 72 is connected to a gated leveltrol 76, as shown in FIG. 5. In this case, the high level detector 72 communicates with a terminal S1 in the diagram by means of a lead 78*a*. The low level detector 79*a* is also communicated to the gated leveltrol system 76 through a lead 78*b* to the terminal S2.

As seen from the diagram, in order for the circuit to be active, terminal S2 and detector 74 must detect liquid in the tank. When the liquid reaches the level of detector 72, the liquid is drained. The tank 50 includes a drain with a valve and a conduit surrounded by a fuel cooling device 11. When the valve is open, by the switch determined by the circuit in the gated leveltrol system 76, fuel will pass by means of the return pump (not shown) to the tank 30.

Figure 7:
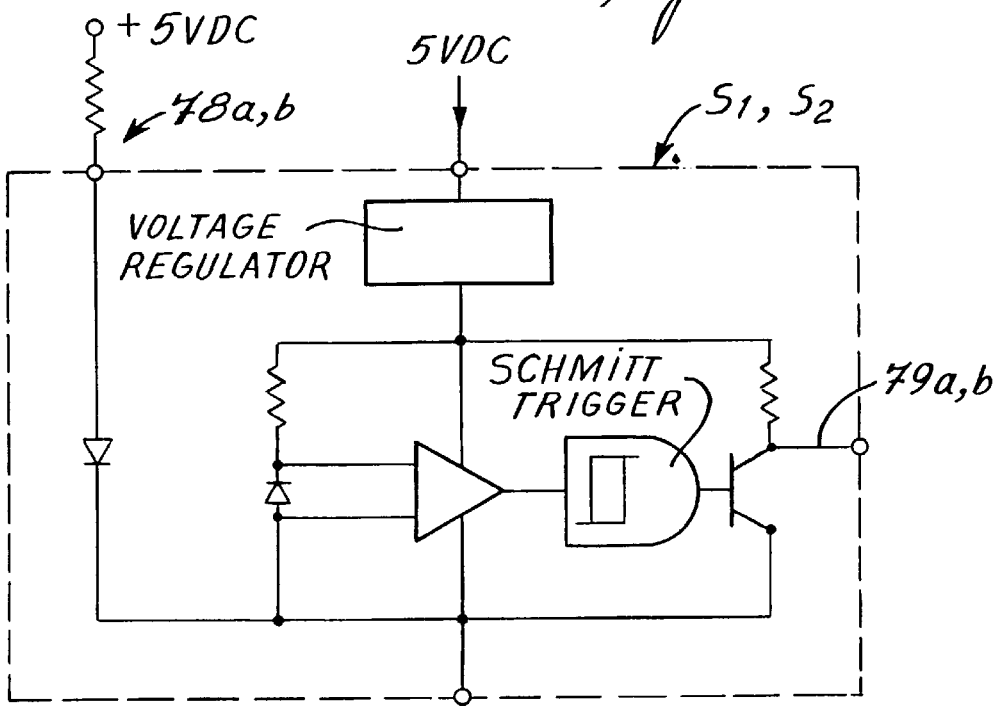
FIG. 7 is a diagram showing a further detail of the present invention.

The details of terminals S1 and S2 on the gated leveltrol 76 are shown in FIG. 7. As seen in FIG. 7, the liquid level sensors S1 and S2 may be manufactured by Honeywell and are a conventional design as shown in the diagram.

Figure 6:
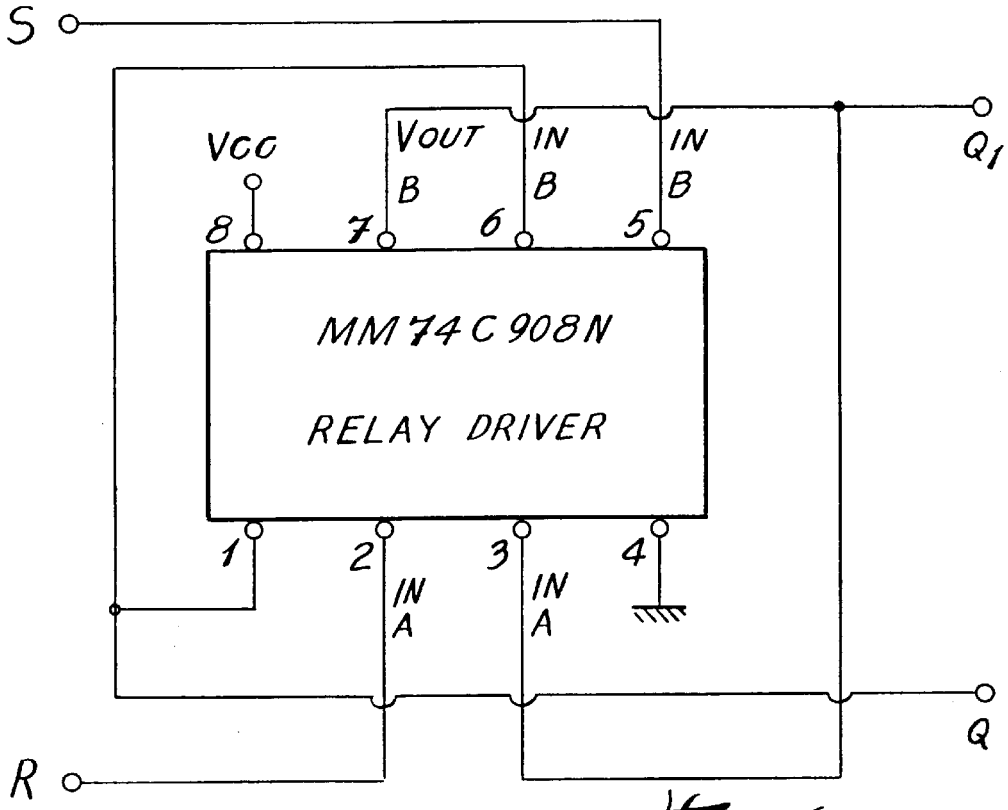
FIG. 6 is a diagram showing yet a further detail of the present invention.

FIG. 6 shows a detail of a relay driver used on the gated controller modules, both in the leveltrol system 76.

The secondary reactor 66 includes a cylindrical housing 80. The discharge of the primary reactor 12 through the conduits 62, 64 passes through a vortex 82 into the secondary reactor 66. Negative electrodes 84 and 86 are located in the secondary reactor 66 to remove negative electrons from the gaseous fuel in the secondary reactor 66. The reactor chamber 81 is also maintained at an elevated temperature and at a negative pressure. In one example, the temperature was observed to be 135° F. (57.2° C.).

A steam generator 88 injects steam into the secondary reactor 66 so as to enhance a secondary reaction with the fuel and air composition. Connected to the steam generator 88 is a high pressure pump 89 and a control unit 90. The high pressure pump 89 pumps distilled water from the distilled water container 92. A check valve 94 is associated with the container 92. A high pressure solenoid valve 96 allows distilled water to enter the steam generator 88 as determined by the electronic injection system. Methyl hydrate may be needed in the container 92 to prevent freezing when ambient temperature is below freezing.

Figure 8:
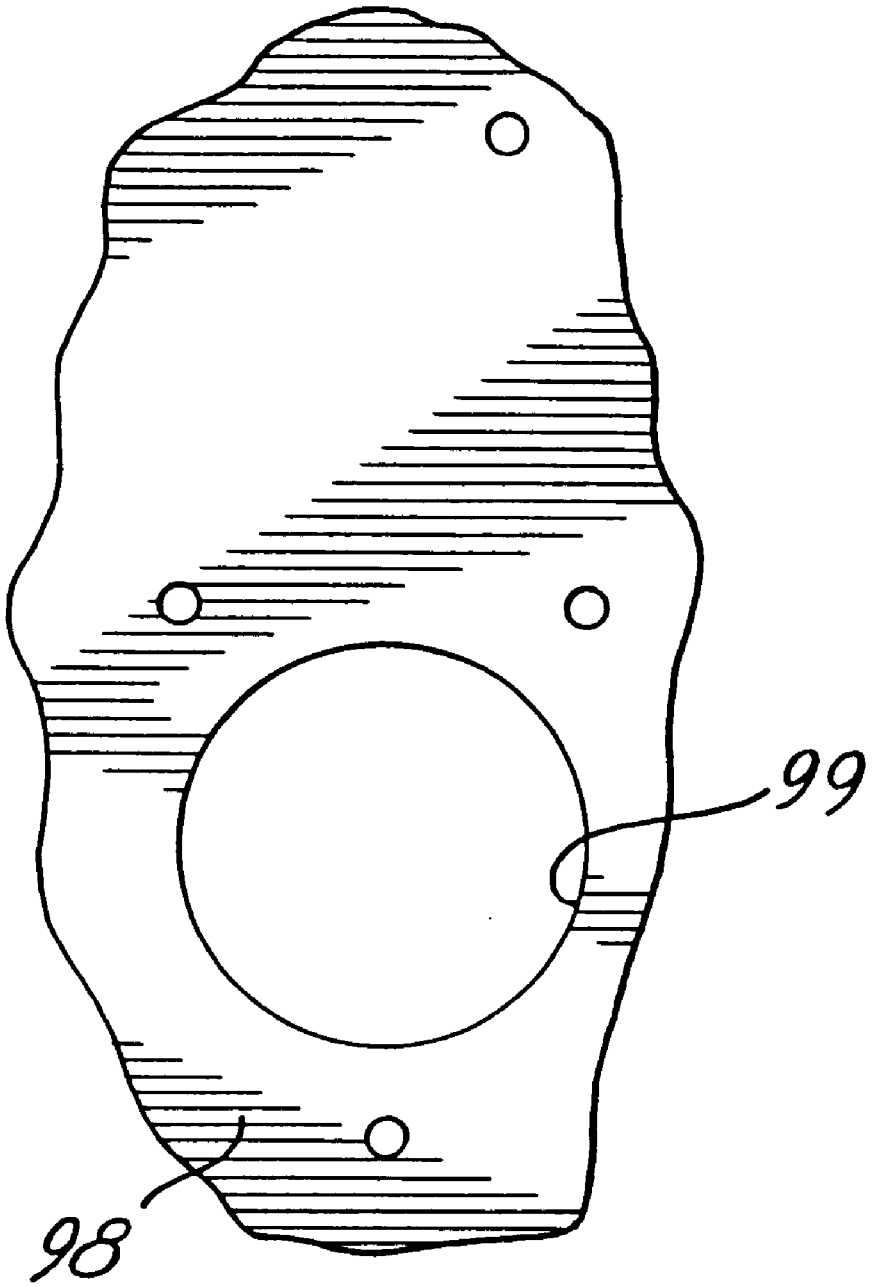
FIG. 8 is a fragmentary top view of a detail of the present invention.

An adapter base 98 is provided for the intake manifold and supports the recirculating fuel chamber 50. An opening 99 in the adapter base 98 is illustrated in FIG. 8 as well as in FIG. 1.

The discharge from the secondary reaction chamber 66 passes into an internal combustion engine manifold to be drawn into the combustion chambers of the engine. The actuator system (not shown) will determine the opening and closing of the throttle plate and the actuation of the reaction chambers to produce the fuel.

Figure 9:
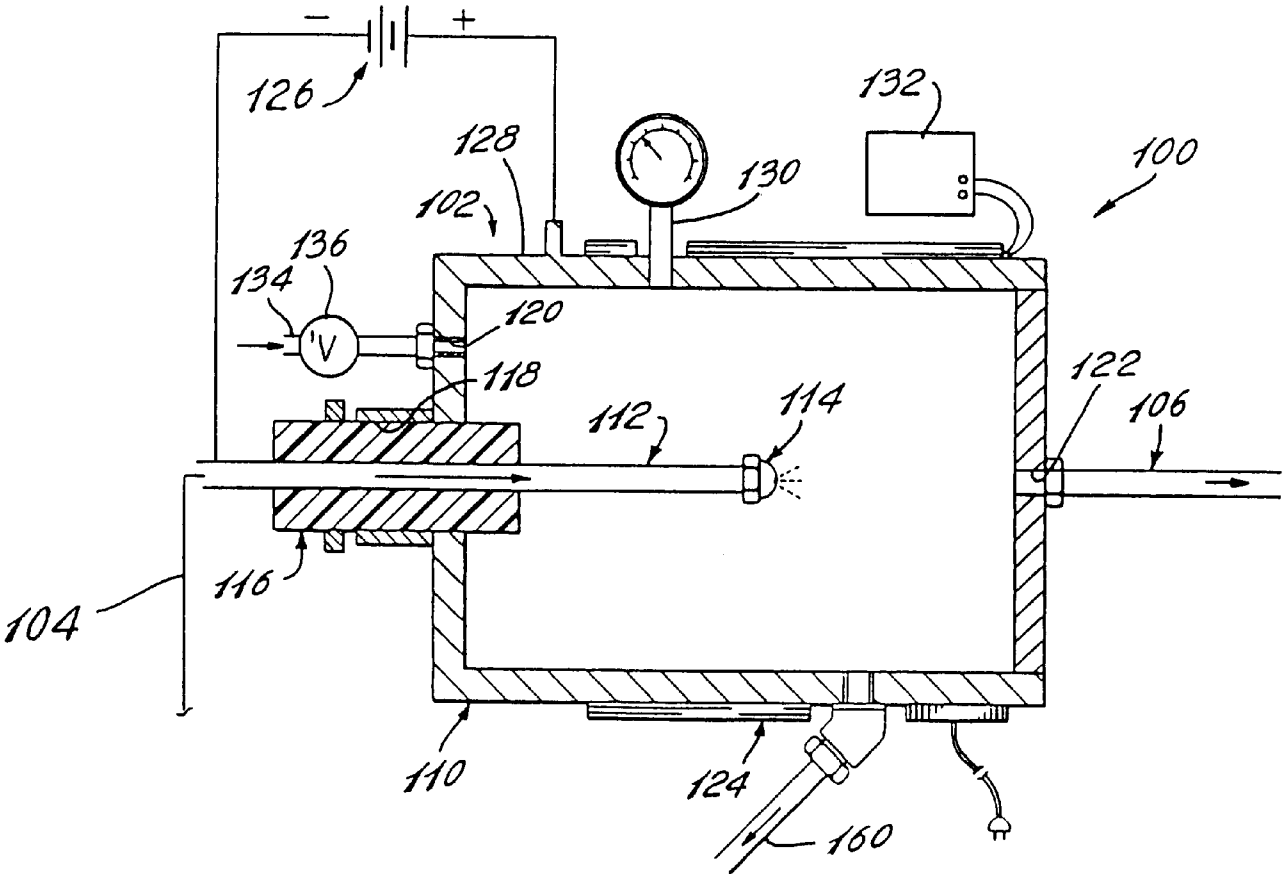
FIG. 9 is a schematic representation of a reactor assembly incorporating a further embodiment of the reactor of the present invention.
Figure 10:
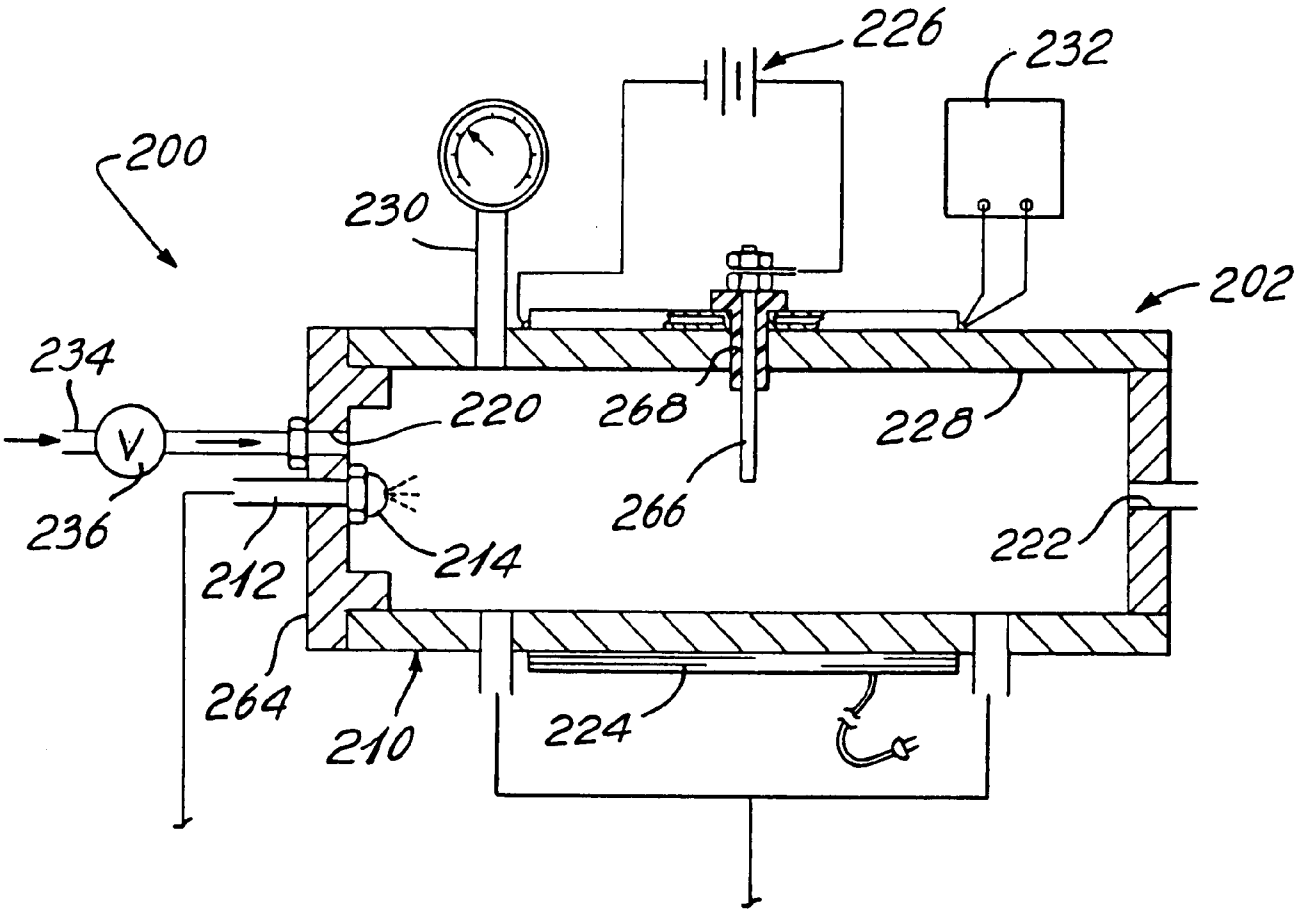
FIG. 10 is a schematic representation of a reactor assembly incorporating a still further embodiment of the present invention.
Figure 11:
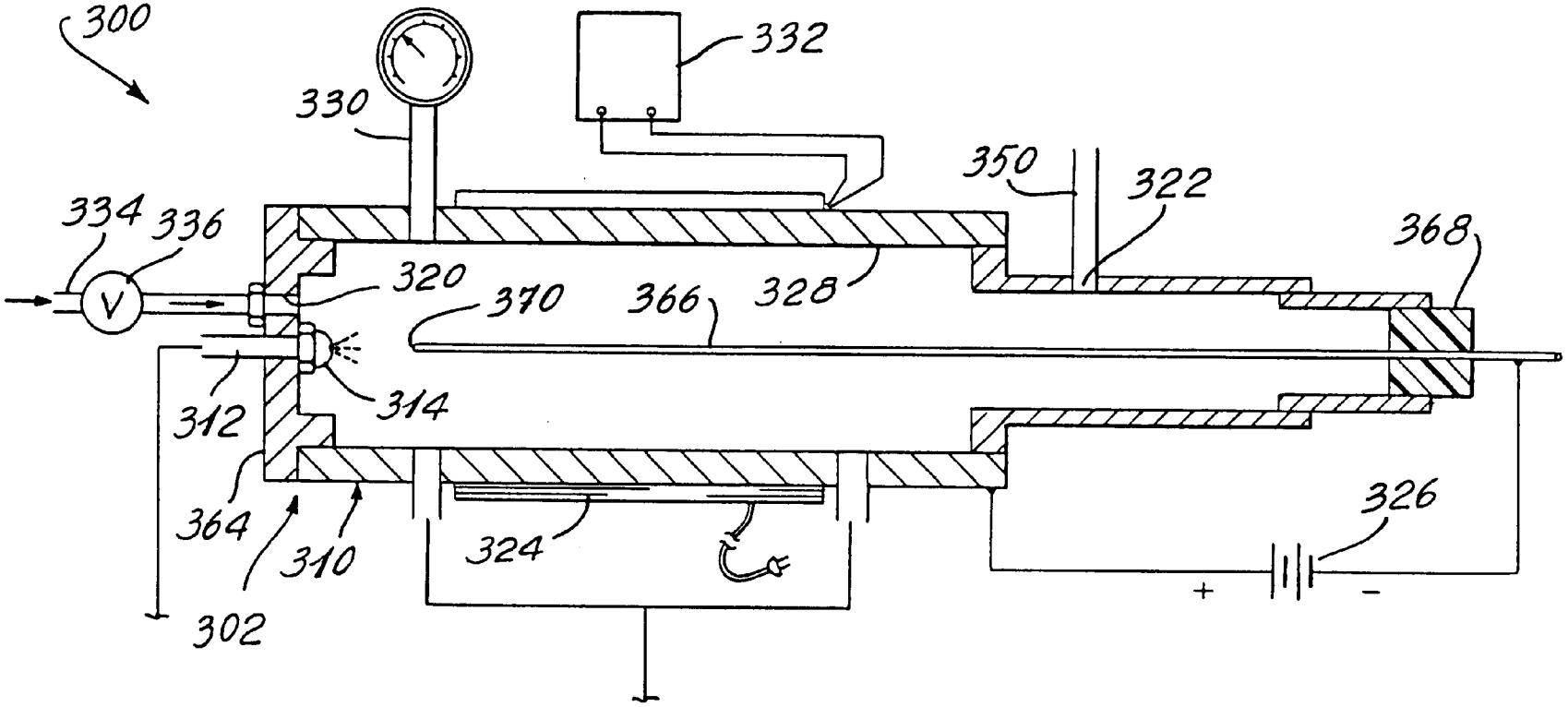
FIG. 11 is a schematic representation of a reactor assembly incorporating a still further embodiment of the present invention.

FIGS. 9 through 11 show various embodiments of the primary reactor as described in copending PCT application PCT/CA98/00367, filed Apr. 16, 1998.

With reference to FIG. 9, reactor assembly 100 comprises a reactor 102.

Reactor 102 comprises a housing 110, a fuel delivery pipe 112 which terminates in a spray nozzle 114 is mounted in an electrically insulating sleeve 116 in a port 118 in housing 110. Reactor 102 includes an air inlet port 120 and a fuel outlet port 122.

A heating element 124 surrounds housing 110 and a voltage source 126 is connected between a wall 128 of housing 110 and pipe 112 such that pipe 112 and wall 128 form spaced-apart electrodes across which a continuous ionizing direct current potential difference is established.

A vacuum gauge 130 monitors the vacuum in housing 110 and a thermocouple meter 132 monitors the temperature of reactor 102 established by heating element 124.

Feed line 134 feeds air or oxygen to housing 110, the flow being controlled by a metering valve 136.

Fuel supply 104 from a fuel tank (not shown) communicates with fuel delivery pipe 112.

Output fuel line 106 communicates with a secondary reactor, as shown in FIGS. 1 to 3.

Reactor 102 further includes a drain line 160 to a recirculation tank, such as shown at 50 in FIGS. 1 and 2.

With further reference to FIG. 10, there is shown an assembly 200 having a reactor 202.

Reactor 202 has a housing 210 and a spray nozzle 214 at the end of a delivery pipe 212 in an end wall 264 of housing 210. An electrode 266 is mounted in an electrically insulating sleeve 268 extending through wall 228. Other components of assembly 200 which correspond to those of assembly 100 in FIG. 9 have the same identifying integers increased by 100. In this case, a continuous ionizing direct current potential difference is established by voltage source 226 between electrode 266 and wall 228.

With further reference to FIG. 11, there is shown an assembly 300 having a reactor 302.

Reactor 302 has a housing 310 and a spray nozzle 314 at the end of a delivery pipe 312 in an end wall 364 of housing 310. An elongate metal rod 366 extends within housing 310 being mounted in an electrically insulating sleeve 368 in wall 328 of housing 310. An inner end 370 of rod 366 is in spaced apart relationship with spray nozzle 314 so that fuel sprayed into housing 310 from spray nozzle 314 flows about rod 366.

Voltage source 326 is connected between rod 366 and housing wall 328. In this case a continuous ionizing direct current potential difference is established by voltage source 326 between rod 366 and wall 328. Other components of assembly 300 which correspond to those of assembly 100 in FIG. 9 have the same identifying integers increased by 200.

In operation of reactor assembly 100 with reactor 102, 202 or 302, fuel is pumped from a fuel tank to fuel delivery pipe 112, 212 or 312 and the fuel is delivered as a spray from spray nozzle 114, 214 or 314 into the interior of housing 110, 210 or 310.

A d.c. high voltage potential difference typically about 3,000 volts is established by voltage source 126, 226 or 326, and heating element 124, 224 or 324 establishes an elevated temperature typically about 400° F. (204° C.) within housing 110, 210 or 310.

Air is introduced into housing 110, 210 or 310 from line 134.

The high voltage potential difference and elevated temperature produce a fine dispersion of charged fuel droplets in housing 110, 210 or 310 which charged fuel droplets together with the air introduced by line 134 is drawn from housing 110, 210 or 310 by the vacuum pump 158 of motor 108, via fuel outlet port 122, 222 or 322, and the secondary reactor (not shown).

We claim:

1. An apparatus for producing a highly combustible fuel comprising a reactor chamber maintained under negative pressure and heat, means for spraying an atomized fuel under pressure into the reactor chamber forming atomized droplets, means for supplying a high voltage electrical voltage direct current potential differential under non-arcing conditions, including at least one electrode located in the reaction zone, for providing combustible fuel having negatively charged particles, and means for passing the resulting atomized fuel to the manifold of an internal combustion engine.

2. The apparatus for producing a highly combustible fuel as defined in claim 1, characterized in that the reactor chamber is a primary reactor chamber maintained under negative pressure and heat, means for passing the resulting gases to a second reactor chamber maintained under negative pressure and heat, whereby the second chamber defines a second reaction zone, means for introducing steam into the second reaction zone with the gases from the primary chamber, at least one electrode in the second reaction zone, and means for introducing the resultant fuel gases from the second reaction chamber into the manifold of an internal combustion engine.

3. The apparatus as defined in claim 2, characterized in that the reactor is maintained at an elevated temperature of between 250° F. (121.2° C.) and 450° F. (232.4° C.).

4. The apparatus as defined in claim 1, characterized in that the electrical potential differential is between 900 and 10,000 volts D.C. and the current flow is between 0.2 to 0.8 microamps.

5. The apparatus as defined in claim 4, characterized in that the reactor is maintained at an elevated temperature of between 250° F. (121.2° C.) and 450° F. (232.4° C.).

6. The apparatus as defined in claim 1, wherein the potential differential is between 200 and 8,000 volts D.C.

7. The apparatus as defined in claim 6, characterized in that the reactor is maintained at an elevated temperature of between 250° F. (121.2° C.) and 450° F. (232.4° C.).

8. The apparatus as defined in claim 1, characterized in that the reactor is maintained at an elevated temperature of between 250° F. (121.2° C.) and 450° F. (232.4° C.).

9. The apparatus as defined in claim 1, wherein the electrodes are maintained with a negative charge and an electrical field is formed between a first electrode that is also a fuel spray nozzle and the second electrode that is a wall forming the reactor chamber.

10. An apparatus as defined in claim 1 wherein there are means for introducing the oxygeneous gas into the reactor chamber to mix in a reactor zone with the atomized fuel.

11. An apparatus for producing a highly combustible fuel comprising means for spraying liquid fuel into a chamber under negative pressure and heat, means for injecting air into the chamber, means for applying an electrical potential in the chamber for producing an intermediate fuel, means for introducing the intermediate fuel into a second reaction chamber, means for introducing steam into the second reaction chamber with the intermediate fuel, means for introducing an electrical potential into the second chamber for producing a final high combustible fuel, and means for immediately inducing said final high combustible fuel into the manifold of an internal combustion engine.

* * * * *